US007358673B2

(12) United States Patent
Frye et al.

(10) Patent No.: US 7,358,673 B2
(45) Date of Patent: Apr. 15, 2008

(54) ELECTRIC LAMP WHICH IS CLOSED ON TWO SIDES

(75) Inventors: Lambert Frye, Steinheim (DE); Jürgen Gräf, Augsburg (DE); Karl Röder, Steinheim (DE); Bernhard Ulbrich, Weissenhorn (DE)

(73) Assignee: Patent-Treuhand-Gesellschaft für elektrische Glühlampen mbH, Munich (DE)

( * ) Notice: Subject to any disclaimer, the term of this patent is extended or adjusted under 35 U.S.C. 154(b) by 519 days.

(21) Appl. No.: 11/180,677

(22) Filed: Jul. 14, 2005

(65) Prior Publication Data

US 2006/0022570 A1 Feb. 2, 2006

(30) Foreign Application Priority Data

Jul. 30, 2004 (DE) ..... 10 2004 036 977

(51) Int. Cl.
*H01J 17/18* (2006.01)

(52) U.S. Cl. ..... 313/623; 313/318.02

(58) Field of Classification Search ..... 313/623–625, 313/318.02

See application file for complete search history.

(56) References Cited

U.S. PATENT DOCUMENTS

| | | | | |
|---|---|---|---|---|
| 7,253,562 | B2 * | 8/2007 | Graf et al. | 313/623 |
| 2002/0063529 | A1 | 5/2002 | Fukai et al. | |
| 2002/0067115 | A1 | 6/2002 | Nagata et al. | |

FOREIGN PATENT DOCUMENTS

| | | |
|---|---|---|
| CA | 2042143 | 12/1991 |
| DE | 103 25 553 | 12/2004 |

* cited by examiner

*Primary Examiner*—Vip Patel
(74) *Attorney, Agent, or Firm*—William E. Meyer

(57) ABSTRACT

The bulb of the lamp is closed at opposite ends by sealing parts (6), with in each case one cap (8) being fitted at one end, the cap having an electrical contact element (13) which is connected in an electrically conductive manner to a supply conductor (15) leading to a luminous means, the contact element being accommodated in a tubular extension (11) of the sealing part. The cap part (8) has an adjustment part (14; 24), which is directed inward with respect to the interior of the lamp and is in contact with the sleeve (11) via a bracket.

18 Claims, 6 Drawing Sheets

ELECTRIC LAMP WHICH IS CLOSED ON TWO SIDES

TECHNICAL FIELD

The invention relates to an electric lamp which is closed on two sides and which has an elongate bulb, which is closed off in a vacuum-tight manner, which defines a longitudinal axis and in which is situated a luminous means, the bulb being closed at opposite ends by sealing parts, with in each case one cap part being fitted to a sealing part, the cap part having an electrical contact element which is connected in an electrically conductive manner to a supply conductor leading to the luminous means, the contact element being accommodated in a tubular sleeve, in particular an extension, of the sealing part. The invention deals in particular with metal halide lamps, but also other types of high-pressure discharge lamps or halogen incandescent lamps.

BACKGROUND ART

U.S. Pat. No. 5,932,955 has already disclosed an electric lamp which is closed on two sides and in which two cap parts have contact elements which are seated in tubular extensions at the end of pinches which are responsible for sealing. The contact elements extend transversely with respect to the lamp axis and are surrounded by the tubular extensions as sleeves. Securing is effected along the circumference of the contact elements. One drawback of this is that the contact elements can easily become tilted, and consequently they are no longer positioned exactly transversely with respect to the lamp axis and, moreover, the risk of fracturing is relatively high.

DE-A 103 25 553.2 (as yet unpublished) has disclosed a lamp of the generic type which is equipped with two radially outwardly directed centering parts in order to adjust a contact element of the cap. However, the adjustment operation is relatively complex and has to be carried out carefully, since the adjustment part does not center itself, which means that rapid automated production is not readily possible.

DISCLOSURE OF THE INVENTION

It is an object of the present invention to provide a lamp which is closed on two sides and which has an elongate bulb, which is closed off in a vacuum-tight manner, which defines a longitudinal axis and in which is situated a luminous means, the bulb being closed at opposite ends by sealing parts, with in each case one cap part being fitted to a sealing part, the cap part having an electrical contact element which is connected in an electrically conductive manner to a supply conductor leading to the luminous means, the contact element being accommodated in a tubular sleeve, in particular an extension, of the sealing part and which lamp has a simple, securely fitted and precisely oriented cap.

This object is achieved by the following features of claim 1: an adjustment part, which is directed toward the lamp interior and comprises an outwardly protruding and self-aligning bracket that is in contact with the tubular sleeve, is attached to the contact element.

Particularly advantageous configurations are to be found in the dependent claims.

The lamp which is closed on two sides in accordance with the invention has an elongate bulb, which is closed off in a vacuum-tight manner, defines a longitudinal axis and is closed at opposite ends by sealing parts, with in each case one cap being fitted at one end of the sealing part. The cap has an electrical contact element which is connected in an electrically conductive manner to a supply conductor leading to a luminous means in the interior of the lamp. According to the invention, the contact element, together with an adjustment part, is anchored in a tubular region, in particular a tubular extension, of the sealing part. The adjustment part, which is directed from the contact element toward the lamp interior, is connected to the contact element. It has at least one outwardly protruding, self-adjusting centering part, which is in contact with the tubular extension. The contacting adjusts the contact element. The adjustment part is therefore arranged between contact element and lamp interior.

The present invention in particular involves an elongate bulb, which is closed off in a vacuum-tight manner, defines a longitudinal axis and in which is situated a luminous means, the bulb being closed at opposite ends by sealing parts. In each case one cap is fitted to a sealing part, the cap having an electrical contact element which is connected in an electrically conductive manner to a supply conductor leading to the luminous means via an adjustment part. The contact element is accommodated in a tubular part of the sealing part, in particular a region or an extension. The adjustment part, which is directed toward the lamp interior and is equipped with an outwardly protruding and self-adjusting centering part, referred to here as a bracket, which is in contact with the tubular extension or region, is attached to the contact element.

The bracket is preferably a bracket which has a spring action and is accessible to a rocking movement in particular for self-adjustment purposes and which is fitted to the adjustment part laterally with respect to and at a distance from the axis of the lamp.

The self-adjustment is facilitated by the adjustment part having two approximately axially parallel rail pieces which, together with the centering part, allow three-point bearing, as seen in cross section. The bearing points of the rail pieces are arranged on the other side of the axis.

Furthermore, according to an advantageous configuration, the adjustment part has at least one, preferably two bushes or cutouts for holding the supply conductor. If there are two bushes, the stability of the connection is higher and the orientation of the supply conductor can be set more accurately.

It is advantageous for the adjustment part and optionally also the contact element to be made from steel, in particular spring steel. In this case, the two may be cut in a single part out of a single piece and then bent appropriately into shape.

The contact element is generally disk-like in form. For better contact-connection, it may also bulge outward toward the mount, in the manner of a dish.

For stabilization purposes, the adjustment part may preferably have two side walls, which are oriented axially parallel and are connected to one another via at least one, preferably two, bridge parts. In this case, the rail pieces may in particular each represent narrow sides of the side walls.

It is expedient and space-saving for the one or each bush to be attached to a bridge part via an extension part.

The bracket is advantageously an arm which is inclined outward slightly with respect to the axis, is made from spring steel and in particular is formed integrally with the remainder of the adjustment part. It either presses onto the surrounding wall of the tubular extension or is fused into the surrounding wall of the tubular extension, which represents a sleeve. In particular, the free tip of the bracket has a reduced inclination compared to the arm itself. This makes it easier to introduce the adjustment part into the tubular region. This forms a type of joint, facilitating the self-centering action.

It is preferable for the inclination of the arm to be from 5° to 20° with respect to the lamp axis, so that the adjustment part can easily be introduced into the tubular extension, with the bracket ultimately being under stress and thereby effecting a holding action, which can be improved still further by a groove assigned to the bracket. The groove is positioned in the tubular region.

In particular, at the free end of the bracket the tip of the arm is bent back toward the axis, in order to avoid damage to the surrounding tubular region during introduction of the adjustment part.

In detail, each rail piece preferably comprises at least two sections of the side wall, located one behind the other in the axial direction. The configuration of the rail pieces is such that the edge inclinations of the two sections with respect to the axis are from approximately 3 to 20° and differ from one another by at least 2°, preferably by approximately 5 to 15°. The sections are preferably in a roof shape, in that the edge inclinations are in principle oriented in opposite directions, and in particular they may be symmetrical.

There is preferably at least one further section. This is inserted between the first two sections. In particular, it may, but does not have to, be oriented axially parallel. In particular, the edge inclination may also change continuously between the two end points, which in this specific case represent, as it were, the first two sections.

Optimum interaction between rail piece and bracket is achieved if the axially parallel section of the rail piece is arranged at approximately the same distance from the luminous means or center point of the lamp as the intermediate piece of the bracket. The term intermediate piece is to be understood as meaning the location of the seam between the two differently inclined parts of the bracket.

In particular, the two rail pieces may also have different individual edge inclinations of their two sections.

In particular, adjustment part and contact element are made from a single piece, in which case the material used is generally stainless steel, tungsten or molybdenum or another conductive metal. It may also be assembled from two or three parts.

In principle, the above concept is suitable for many types of lamps, in particular for discharge lamps or incandescent lamps. It is particularly preferable for lamps with an outer bulb. The outer bulb may completely or partially surround the discharge vessel. The lamp stems may be pinched or fused.

The contact element is usually disk-like in form, specifically, in general, as a circular disk or an oval with a smooth or jagged edge.

In a particularly preferred embodiment, the cap comprises an adjustment part made from spring steel sheet. One particular advantage of the invention is that it allows high manufacturing tolerances to be set. Whereas standard techniques, cf. DE-A 103 25 553.2, require a high level of accuracy in production of the component of typically 2/100 mm, the component according to the invention, on account of its self-centering action, only requires an accuracy of 2/10 mm. The component, which acts as a clip, automatically slips into the correct position after it has been inserted into the sleeve.

The entire structure is reinforced by the contact element being connected to the supply conductor both directly and via the centering element.

A typical application is metal halide lamps and halogen incandescent lamps with and without outer bulb.

BRIEF DESCRIPTION OF THE DRAWINGS

In the text which follows, the invention is to be explained in more detail on the basis of a number of exemplary embodiments. In the drawing.

BEST MODE FOR CARRYING OUT THE INVENTION

Figure 1:
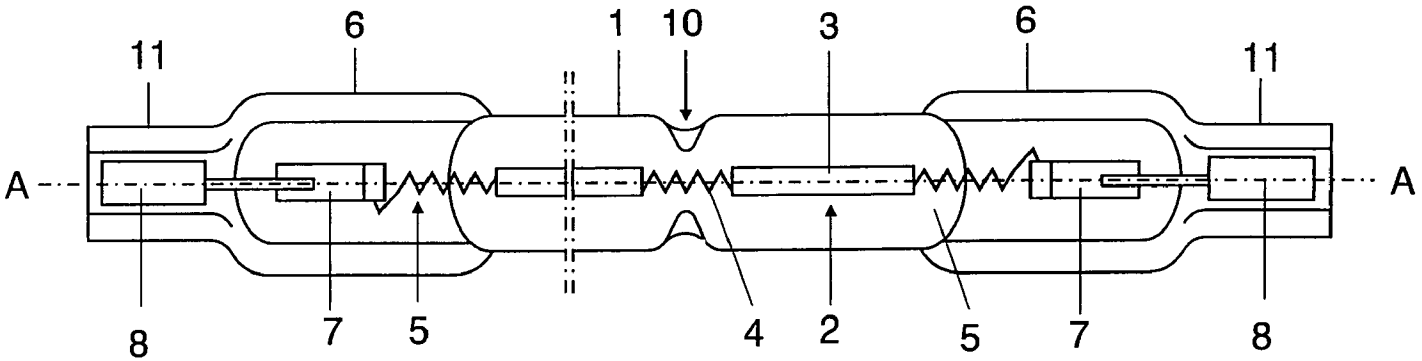
FIG. 1 shows a side view of a halogen incandescent lamp.

FIG. 1 shows a side view of a halogen incandescent lamp which is pinched on two sides. It comprises a cylindrical bulb 1 in which a luminous body 2 is arranged axially and into which a halogen-containing fill has been introduced. The luminous body is held in the bulb 1 by lugs 10.

The luminous body 2 comprises luminous sections 3 with a small pitch which are separated from one another by non-luminous sections 4 with a large pitch. The ends 5 of the luminous body, in their function as inner supply conductor, are embedded directly in the pinch 6, where they are connected to a molybdenum foil 7.

An extension in the form of a tubular glass sleeve 11 is formed on the outside of the pinch 6. The sleeve 11 is narrower than the wide side of the pinch 6 but wider than the narrow side of the pinch 6.

A cap part 8, which is only diagrammatically indicated and is made from steel sheet (V2A) or spring steel sheet with a thickness of 0.4 mm, is clamped in the sleeve 11.

A molybdenum wire with a diameter of 0.6 mm as outer supply conductor 15, which is welded to the cap part 8, is arranged between foil 7 and cap part 8.

Figure 2:
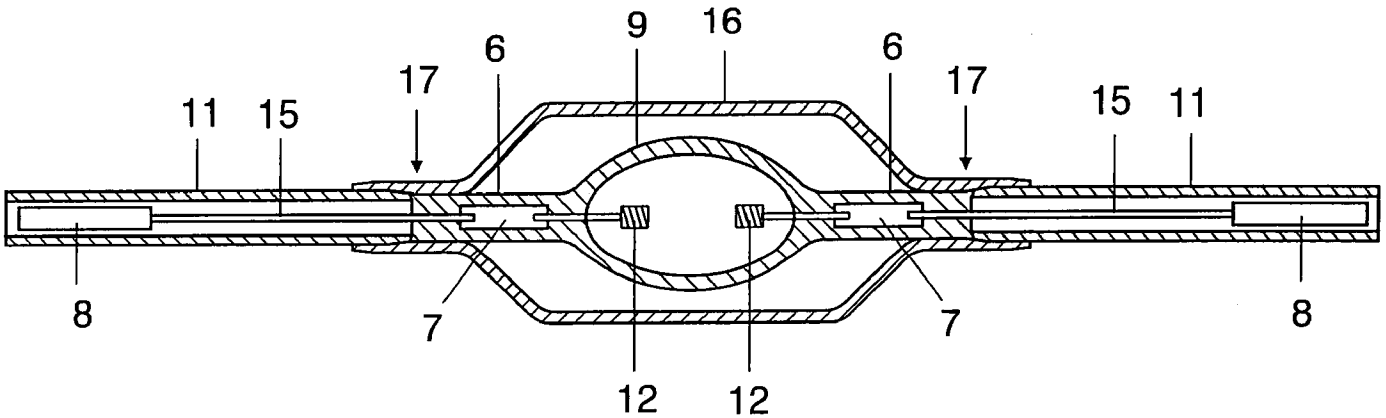
FIG. 2 shows a side view of an exemplary embodiment of a metal halide lamp.

FIG. 2 shows a further exemplary embodiment of a metal halide lamp. Unlike in FIG. 1, the discharge vessel, which is in the form of a barrel body 9 and is made from quartz glass, encloses two electrodes 12 as well as a metal halide fill. The bulb ends are sealed by pinches 6, in which foils 7 are embedded. The outer supply conductor 15 is guided in a tubular sleeve 11, which here represents an extension of the discharge vessel, and ends in the diagrammatically depicted cap part 8. The cap is produced as a single piece of steel and also comprises a circular disk 13 as contact element. The convex part of the discharge vessel is surrounded by an outer bulb 16, which is rolled on (17) in the region of the transition between the pinch 6 and the sleeve 11.

One possible mode of production is described, for example, in U.S. 2002/063 529, U.S. 2002/067 115 or U.S. Pat. No. 5,128,589. A variant with a complete outer bulb is described, for example, in CA 2 042 143. The concept according to the invention can be used for all these designs.

Figure 3:
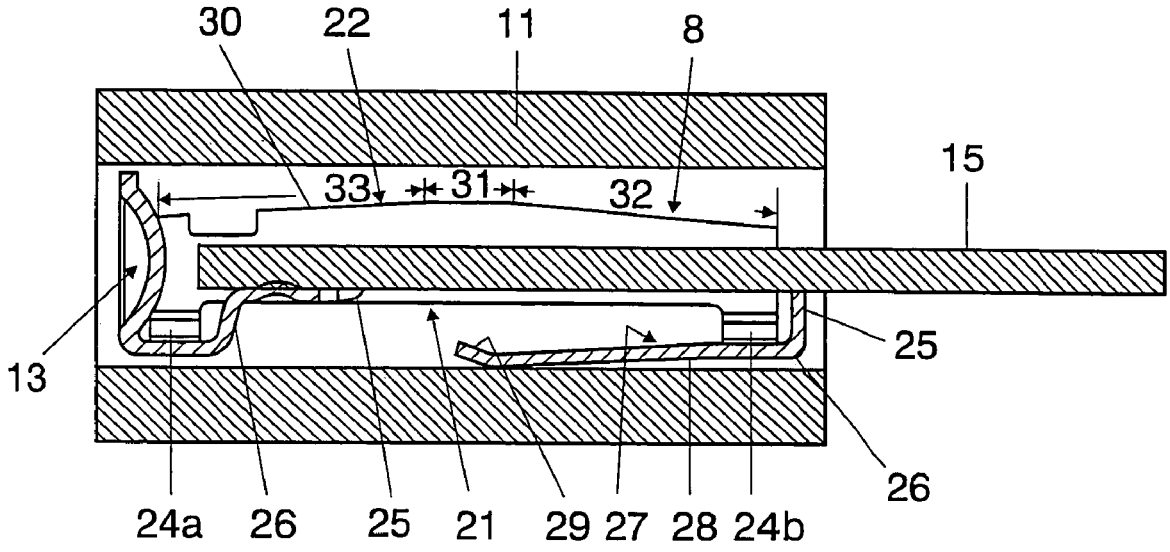
FIG. 3 shows an exemplary embodiment of a cap in section.

A very good self-centering exemplary embodiment of a cap 8 is shown in FIG. 3. The cap 8 comprises a dish-like contact element 13, the lower edge of which is attached to the outer supply conductor 15 via an adjustment part 21. The adjustment part 21 is integral with the contact element 13. It is made from spring steel sheet in such a way that it has a particularly stable, vibration-resistant and in particular self-centering action. For this purpose, the adjustment part 21 has a base part with two rail pieces 22 (only one of which is visible in the section illustrated), which act as side walls running parallel to the outer supply conductor 15. In a plane transversely with respect thereto are two bridge parts 24*a*, 24*b*. The bridge parts 24 connect the two rail pieces 22, 23 in the vicinity of their respective ends. The supply conductor 15 is mounted in two upwardly open bushes 25 which branch off from the bridge parts 24 via two extension parts 26. They are connected to the latter, for example by soldering or welding.

A bracket 27 is attached to the rear bridge part 24*b*, specifically in the opposite direction to the extension part 26 bearing the bush. This bracket 27 comprises a long arm 28, which is inclined slightly outward with respect to the lamp axis and is adjoined by a short free tip 29, which is for its part inclined slightly back toward the axis of the lamp. This bracket 27 is responsible for the self-centering action together with the rail pieces 22, 23, since it presses against the sleeve 11 and tilts the adjustment part 21 in such a way that it sets the supply conductor axially parallel. The narrow sides 30 of the rail pieces 22 serve as an abutment for a three-point bearing. These are configured in such a way that they bear in punctiform fashion against the inside of the wall of the sleeve 11.

This self-centering action functions particularly well because the rail pieces 22, 23 do not have a straight narrow side 30, but rather are bent in a similar way to ice skate runners. This curvature may either be continuous or comprise two or more sections of different orientations. FIG. 3 shows a variant in which each rail piece 22 comprises three sections. The middle section 31 is oriented axially parallel, while the front section (32) and rear section (33) are inclined with respect to this direction. It is advantageous for the rear section 33, which adjoins the contact element 13, to be inclined to a lesser extent than the front section 32, which slopes downward in the opposite way. This different inclination defines an adjustment range for the adjustment part.

It is advantageous for the contact element 13 to be spaced apart from the sleeve 11 or at most in purely mechanical contact therewith along its periphery, so that there is no need for a glass deformation process. This has the positive effect that inexpensive material which does not have to be matched to the glass, such as steel, can be used for the contact element 13.

FIG. 4 shows various forms of the rail piece 22. FIG. 4*a* shows a rail piece comprising just two sections 32*a* and 33*a*, which in principle are inclined in opposite directions in the style of a roof. FIG. 4*b* shows a rail piece comprising only two sections 32*b* and 33*b*, which in principle are inclined in the same direction but to different extents. These edge inclinations with respect to the axis are generally in each case approximately 3 to 20°, with the edge inclinations of adjacent sections in each case differing from one another by at least 2°. In particular, the edge inclinations of adjacent sections differ from one another by approximately 5 to 15°.

Figure 4A:
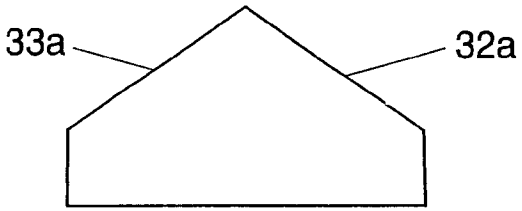
FIG. 4 shows a side view of various exemplary embodiments for rail pieces.
Figure 4B:
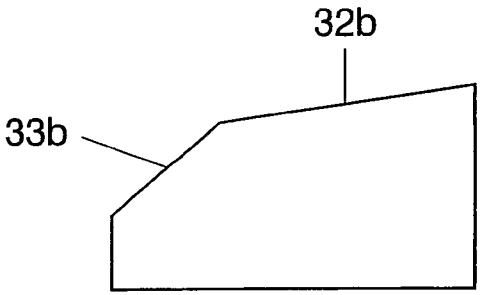
Figure 4C:
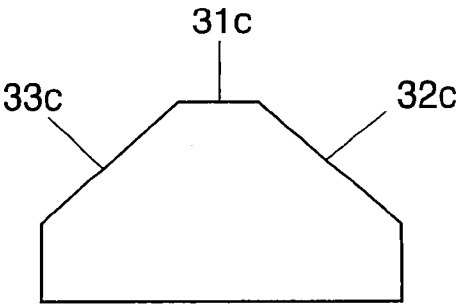

FIG. 4*c* shows a rail piece comprising three sections, in which the middle section (31*c*) is axially parallel and the front section (32*c*) and rear section (33*c*) have the same inclination, but in opposite directions.

Figure 4D:
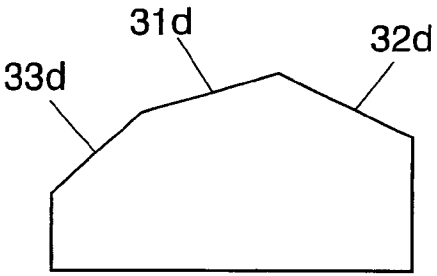

FIG. 4*d* shows a rail piece comprising three sections, in which the middle section (31*d*) is inclined in the same direction but to a lesser extent as the rear section (33*d*), whereas the front section (32*d*) is inclined in the opposite direction.

Figure 4E:
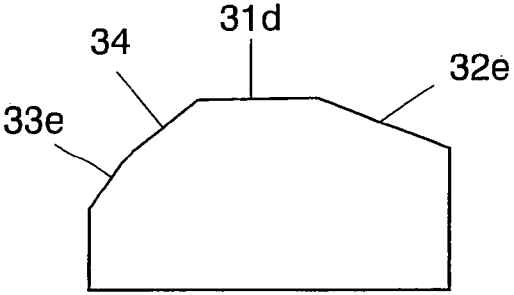

FIG. 4*e* shows a rail piece comprising four sections, with the middle section (31*d*) axially parallel, while the fourth section 34 is inclined in the same direction but to a lesser extent as the rear section (32*e*), while the front section (33*e*) is inclined in the opposite direction.

Figure 4F:
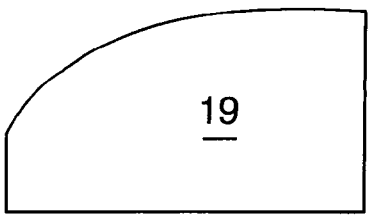
Figure 5:
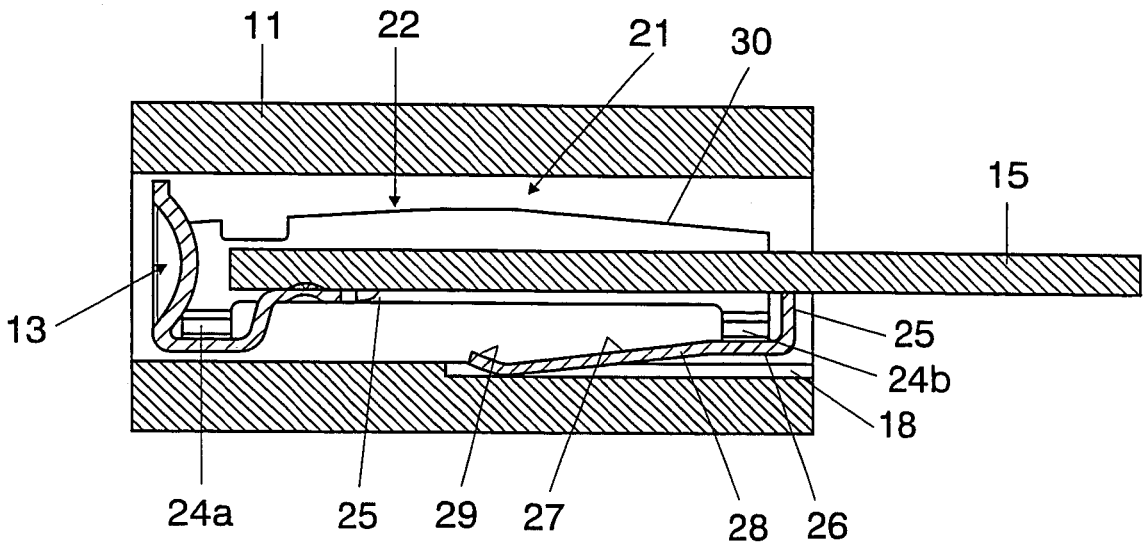
FIGS. 5 to 8 show a further exemplary embodiment of a cap in perspective, side view, plan view and in section.

Finally, FIG. 4*f* shows a rail piece 19 in which the different sections merge into one another in the form of a continuous curvature. In particular, it is possible for the two rail pieces 22, 23 to have different edge inclinations and differently configured sections.

Figure 6:
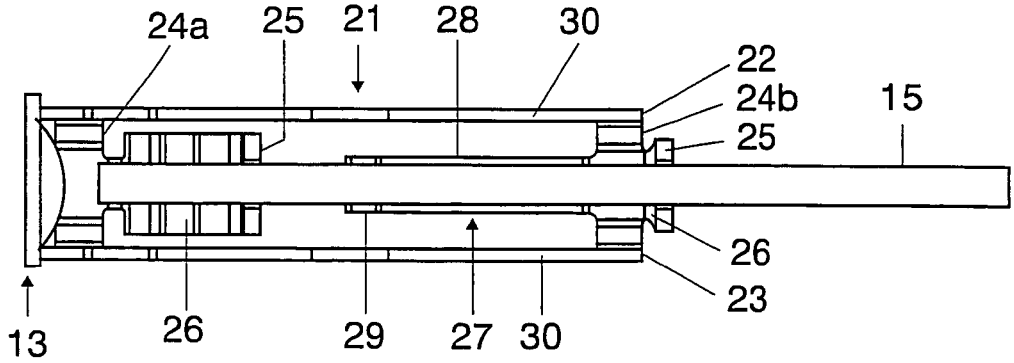
Figure 7:
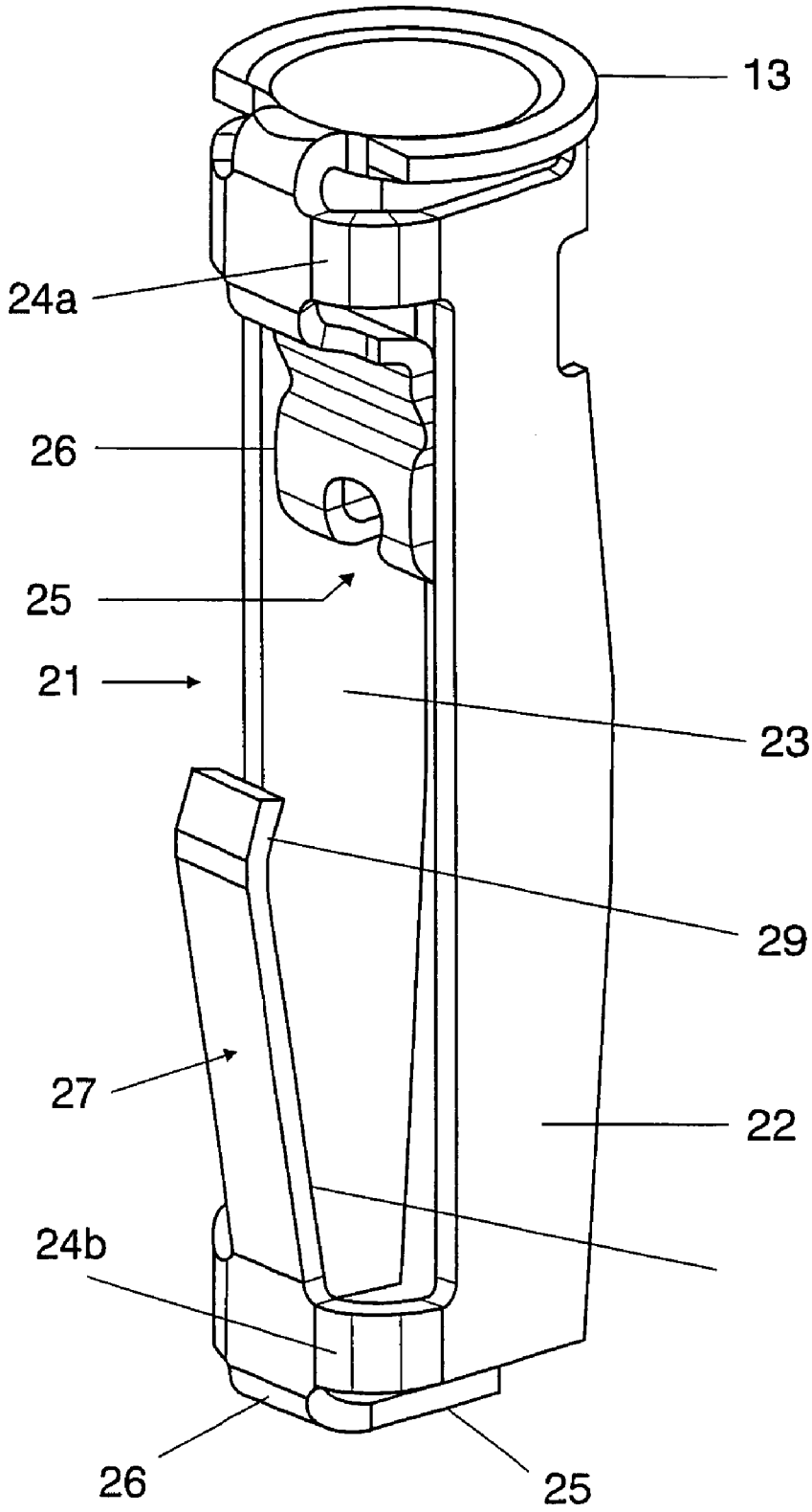
Figure 8:
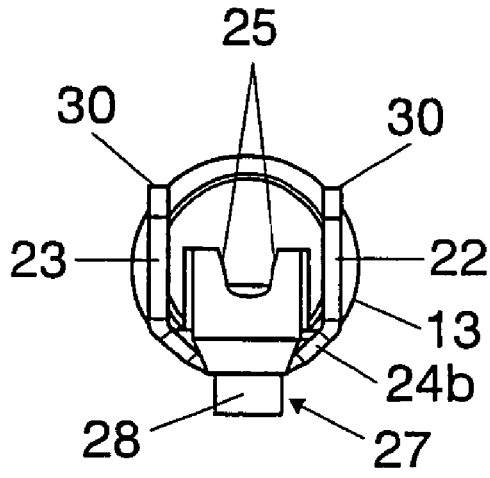

FIGS. 5 to 8 show a further exemplary embodiment of a cap, in which the bracket is guided in a groove 18. Otherwise, identical reference numerals correspond to identical parts. FIG. 6 shows a plan view and FIG. 7 a perspective view and FIG. 8 a view from behind. It is clearly apparent from these figures that the narrow sides 30 of the rail pieces 22, 23 project beyond the diameter of the contact piece 13 and therefore impart the mechanical contact in the sleeve together with the bracket 27 in the sense of a three-point bearing arrangement.

Figure 9:
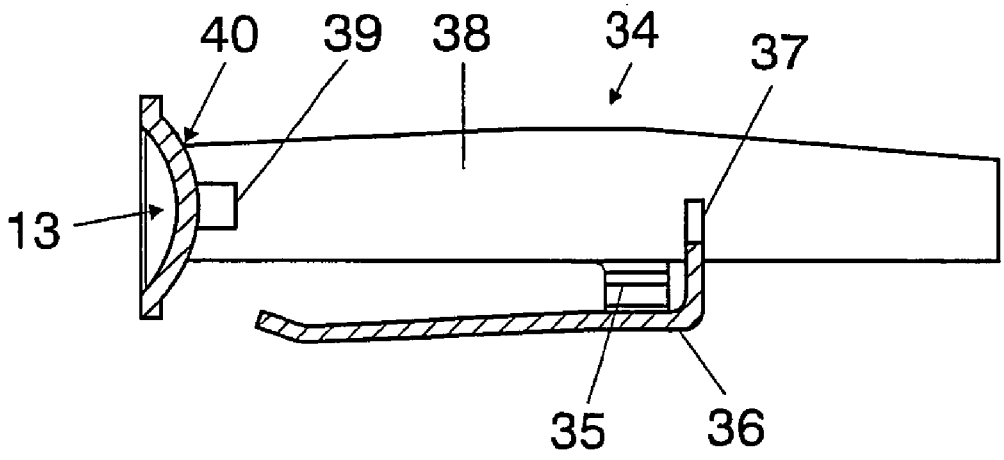
FIG. 9 shows a further exemplary embodiment of a cap in section.

Finally, FIG. 9 shows a further embodiment of the adjustment part 34 for the cap with just one bridge part 35, a connecting part 36 and a bush 37, which are each fitted approximately centrally to the rail piece 38. The connection to the contact element 13 is in this case effected only via the rail pieces 38 at the end side 40 thereof, and moreover the supply conductor (not shown) is guided in a bush 39 at the base of the dish.

What is claimed is:

1. An electric lamp which is closed on two sides and has an elongate bulb, which is closed off in a vacuum-tight manner, defines a longitudinal axis and in which is situated a luminous means, the bulb being closed at opposite ends by sealing parts, with in each case one cap part being fitted to a sealing part, the cap part having an electrical contact element which is connected in an electrically conductive manner to a supply conductor leading to the luminous means, the contact element being accommodated in a tubular sleeve, in particular an extension, of the sealing part, wherein an adjustment part, which is directed toward the lamp interior and comprises an outwardly protruding and self-aligning bracket that is in contact with the tubular sleeve, is attached to the contact element.

2. The lamp as claimed in claim 1, wherein the bracket is provided with a spring action, the bracket being fitted to the adjustment part laterally with respect to and at a distance from the axis.

3. The lamp as claimed in claim 1, wherein the adjustment part comprises at least one, preferably two, rail pieces which, together with the bracket, allow three-point bearing, as seen in cross section, in the sleeve.

4. The lamp as claimed in claim 1, wherein the adjustment part has at least one, preferably two bushes for holding the supply conductor.

5. The lamp as claimed in claim 1, wherein the adjustment part and optionally the contact element is made from steel, molybdenum or another metal.

6. The lamp as claimed in claim 1, wherein the contact element is disk-like in form, with a diameter smaller than the internal diameter of the sleeve.

7. The lamp as claimed in claim 3, wherein the adjustment part has two rail pieces, which are oriented axially parallel and are connected to one another via at least one, preferably two, bridge parts.

8. The lamp as claimed in claim 4, wherein the bush is attached to the bridge part via an extension part.

9. The lamp as claimed in claim 1, wherein the bracket is an arm which is inclined outward slightly with respect to the axis, is made from spring steel, is spread onto the surrounding wall of the sleeve and the tip of which in particular has a different inclination.

10. The lamp as claimed in claim 9, wherein the surrounding wall of the sleeve has a groove which guides the bracket.

11. The lamp as claimed in claim 9, wherein the inclination of the arm is from 5° to 20° with respect to the lamp axis.

12. The lamp as claimed in claim 9, characterized in that at the free end of the bracket the tip is bent back toward the axis.

13. The lamp as claimed in claim 3, wherein each rail piece comprises at least two sections, which are located one behind the other in the axial direction, the edge inclinations of which with respect to the axis are from approximately 3 to 20° and the edge inclinations of which respectively differ from one another by at least 2°.

14. The lamp as claimed in claim 13, in which the edge inclinations of the two sections differ from one another by approximately 5 to 15°.

15. The lamp as claimed in claim 13, wherein the two sections have oppositely directed edge inclinations, in the style of a roof.

16. The lamp as claimed in claim 13, wherein at least one further section, with an edge inclination which is between the inclination of the first two sections, is fitted between the two sections, it being possible in particular for the edge inclination to change continuously between the two edge inclinations of the first two sections.

17. The lamp as claimed in claim 16, wherein the edge inclination of one of the further sections is oriented axially parallel, with in particular this axially parallel section of the rail piece being arranged at approximately the same level on the axis as the intermediate piece of the arm.

18. The lamp as claimed in claim 16, wherein the two rail pieces have different edge inclinations of their sections.

* * * * *